United States Patent [19]

Katoh

[11] Patent Number: 4,916,491

[45] Date of Patent: Apr. 10, 1990

[54] CONTROL DEVICE FOR A COPIER

[75] Inventor: Eiichi Katoh, Tokyo, Japan

[73] Assignee: Ricoh Company, Ltd., Tokyo, Japan

[21] Appl. No.: 263,511

[22] Filed: Oct. 27, 1988

[30] Foreign Application Priority Data

Oct. 27, 1987 [JP] Japan ..... 62-269179
Aug. 29, 1988 [JP] Japan ..... 63-212347

[51] Int. Cl.[4] ..... G03G 21/00; G03G 15/02; G03G 15/06

[52] U.S. Cl. ..... 355/246; 355/208; 355/219; 355/265

[58] Field of Search ..... 355/204, 210, 216, 218, 355/219, 208, 246, 265, 274

[56] References Cited

U.S. PATENT DOCUMENTS 4,382,674 5/1983 Miyoshi et al. ..... 355/219
4,462,679 6/1984 Itaya ..... 355/219
4,674,860 6/1987 Tokunaga et al. ..... 355/274
4,678,317 7/1987 Grossinger ..... 355/216
4,814,834 3/1989 Endo et al. ..... 355/208

*Primary Examiner*—A. T. Grimley
*Assistant Examiner*—Susan Luddy
*Attorney, Agent, or Firm*—Oblon, Spivak, McClelland, Maier & Neustadt

[57] ABSTRACT

In a relatively simple copier lacking a discharging unit which erases those portions of a photoconductive element which precede and follow an image, a control device reduces the amount of toner consumed and the amount of toner collected while preventing toner from being scattered around. For a surface portion of the photoconductive element which is associated with a trailing edge portion of a paper to which the image is to be transferred, a charging operation of a charger adapted to charge the photoconductive drum and a charging operation of a transfer charger are stopped. A bias voltage to be applied to a surface portion of the photoconductive element which follows the above-mentioned surface portion is increased.

5 Claims, 12 Drawing Sheets

CONTROL DEVICE FOR A COPIER

BACKGROUND OF THE INVENTION

The present invention relates to a control device for a copier or similar image recording apparatus which includes a charger for charging a photoconductive element, a bias voltage source for development, a controller for controllably varying the output of the bias voltage source, and sensor for sensing the trailing edge of a paper.

A problem with a copier, printer, facsimile apparatus or similar range recording apparatus which is implemented by electrophtography is that, when use is made of a paper of relatively small size, image fragments remain untransferred in a non-image area of a photoconductive element which follows the trailing edge of such a paper, resulting in wasteful consumption of toner and an increase in the amount of toner collected. This problem may be eliminated by illuminating and thereby erasing the remaining image fragments in the non-image area based on the size of a paper, as disclosed in Japanese Laid-Open Patent Publication No. 60-6966 by way of example. Such an implementation is extensively used with modern copiers and reported to nearly achieve the above purpose. However, since the illumination scheme needs an exclusive eraser and an exclusive driver, the construction become complicated and the cost is increased. The increase in cost is especially problematic when it comes to a miniature image recording apparatus such as a miniature copier with which a simple and inexpensive construction is prior to the others. While a charger for charging a photoconductive element may be turned off when the trailing edge of a paper is sensed, this kind of scheme cannot be implemented without complicating the construction of a control device as well as the control procedure. Another approach recently proposed is increasing a bias voltage for development timed to the detection of the trailing edge of a paper to thereby reduce toner consumption. Although such an approach may provide a plurality of stable bias voltages as desired, it simply reduces toner consumption necessary to develop an image on a photoconductive element and cannot prevent toner from entering a cleaning unit and increasing the load of a cleaning unit. Especially, under those conditions which intensify the adhesion of toner to a photoconductive element, incomplete cleaning is apt to occur.

SUMMARY OF THE INVENTION

It is therefore an object of the present invention to provide, in a relatively simple image recording apparatus lacking a unit for discharging those portions of a photoconductive element which precede and follow an image, a control device for reducing the amount of toner consumed and the amount of toner collected and preventing toner from being scattered around by increasing a bias voltage upon the detection of a trailing edge portion of a paper.

It is another object of the present invention to provide, in an image recording apparatus lacking a unit for discharging those portions of a photoconductive element which precede and follow an image for erasing them and increases a bias voltage upon the detection of the trailing edge of a paper, a control device which stops the charging operation of a transfer charger timed to the trailing edge of a paper.

It is another object of the present invention to provide a generally improved control device for a copier.

A control device for an image recording apparatus having a photoconductive element on which an image to be transferred to a paper is provided, a charger for charging the photoconductive element, and a bias voltage source for outputting a variable bias voltage for development of the present invention comprises a sensor for sensing a first surface portion of the photoconductive element which is associated with a trailing edge portion of the paper when the image is transferred to the paper, and a control for controlling the charger and bias voltage source such that the charger stops charging the first surface portion of the photoconductive element which is associated with the trailing edge portion of the paper and the bias voltage applied by the bias voltage source to a second surface portion of the photoconductive drum which follows the first surface portion is increased.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
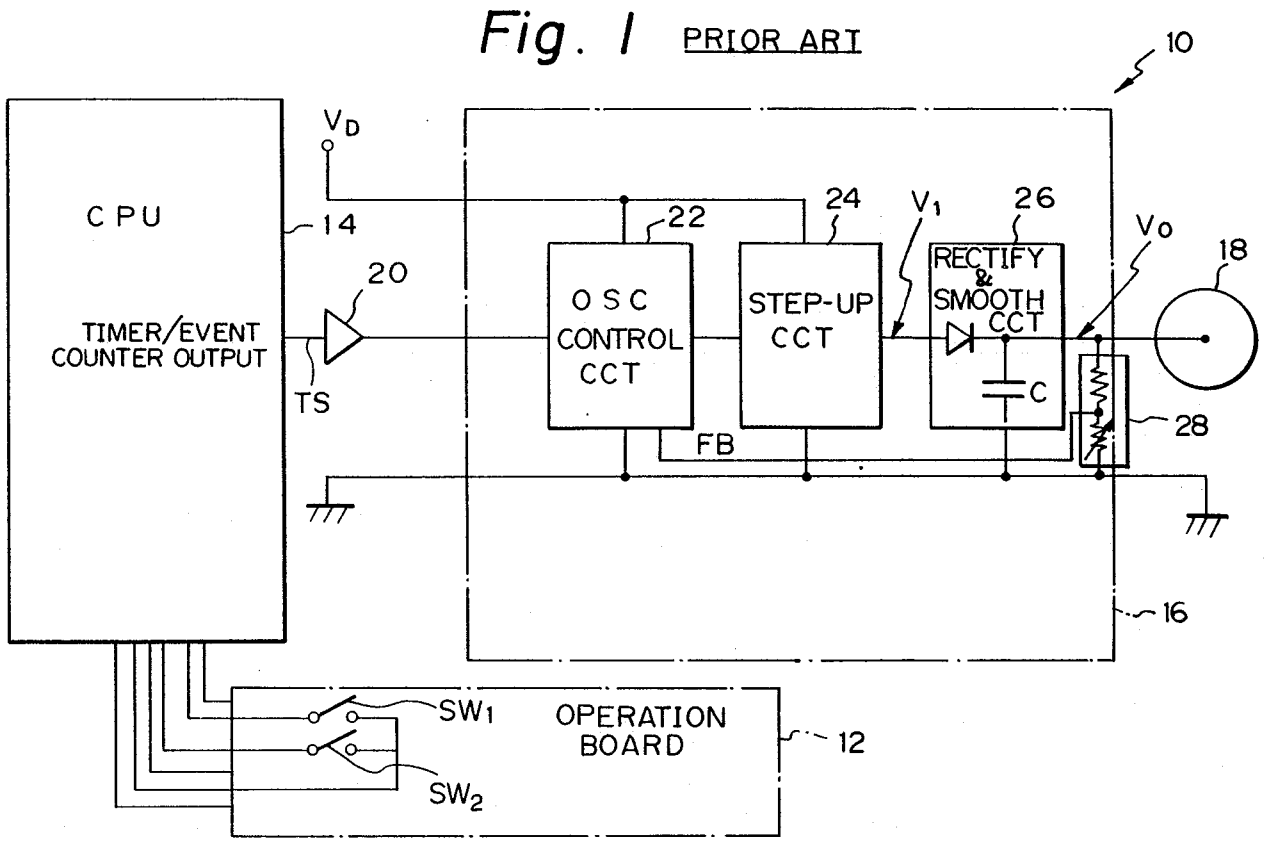
Fig. 1 PRIOR ART
FIG. 1 is a schematic block diagram showing a part of a prior art control device which is constructed to reduce toner consumption and to eliminate scattering of toner by increasing a bias voltage for development when the trailing edge of a paper is sensed.
Figure 2:
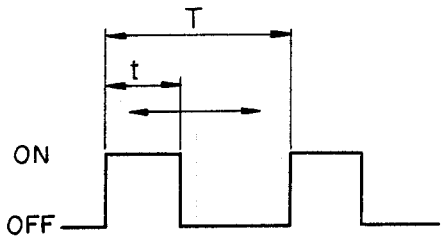
Fig. 2 PRIOR ART
FIG. 2 is a waveform diagram representative of PWM drive pulses adapted to set image density.

To better understand the present invention, a brief reference will be made to a prior art control device for an image forming apparatus in the form of a copier which reduces toner consumption and eliminates scattering of toner by increasing a bias voltage in association with the trailing edge of a paper, shown in FIG. 1. The prior art control device, generally 10, is made up of an operation board 12, a central processing unit (CPU) 14, and a bias voltage source 16. A bias voltage $V_0$ outputted by the bias voltage source 16 is applied to a developing roller 18 of a developing unit. The operation board 12 is provided with key switches SW1 and SW2 for density selection which are operable for selecting "DARK" and "LIGHT", respectively. The key switches SW1 and SW2 are connected to the CPU 14. A trigger signal TS is fed from a timer/event counter of the CPU 14 to the bias voltage source 16. The operation mode of the timer/event counter is so set as to provide a voltage which matches the density selected by the key switch SW1 or SW2 and, as shown in FIG. 2, PWM drive is executed with a predetermined period T and a pulse width t. For example, the period T may be selected to be 1 millisecond while the pulse width t may be varied to change the bias voltage $V_0$. The trigger signal TS applied to the bias voltage source 16 via a driver 20 drives an oscillation control circuit 22 of the voltage source 16 only during a trigger ON period (t), thereby causing the circuit 22 to oscillate (20 to 30 kilohertz). A step-up circuit 24 steps up the output of the oscillation control circuit 22 to produce an AC voltage $V_1$. A rectifying and smoothing circuit 26 rectifies and smoothes the AC voltage $V_1$ and applies its output to the developing roller 18. The reference numeral 28 designates a feedback resistor which is associated with the oscillation control circuit 22.

Figure 3:
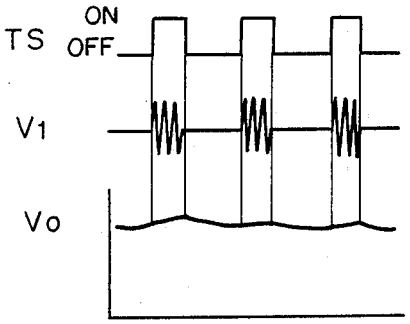
Fig. 3 PRIOR ART
FIG. 3 is a timing chart showing a relationship between a trigger signal, a step-up voltage, and a DC bias voltage.

FIG. 3 shows a relationship between the trigger signal TS, AC voltage $V_1$ and bias voltage $V_0$. Since charge and discharge are respectively repeated in a trigger ON state and a trigger OFF state, the bias voltage remains stable at a level lower than 650 volts, for example, which is associated with a full duty trigger state. The discharge time constant $\tau$ of the bias is dependent upon the insulation resistance of a bias voltage to ground (GND) and the capacity of a smoothing capacitor. Assuming that the insulation resistance is about 10 megaohms and the capacitance is 2200 picofarads, the discharge time constant $\tau$ is expressed as:

$$\begin{aligned}\tau &= 10 \times 10^6 \times 2.2 \times 10^3 \times 10^{-12} \\ &= 2.2 \times 10^{-2} \\ &= 22 \text{ (milliseconds)}\end{aligned}$$

Since such a discharge time constant $\tau$ is far longer than the trigger period T (=1 millisecond), output ripples ascribable to PWM trigger is almost negligible.

Figure 4:
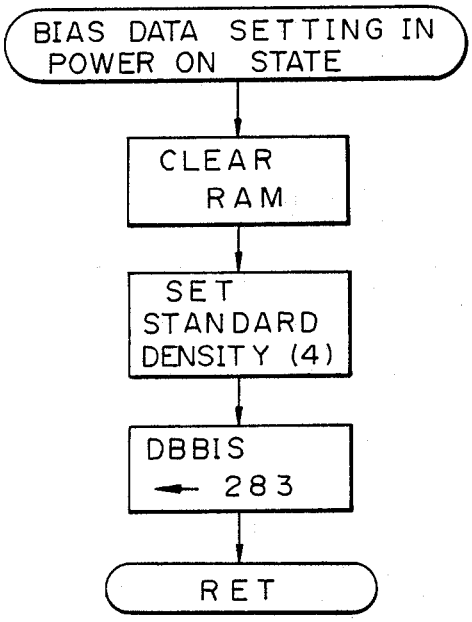
Fig. 4 PRIOR ART
FIG. 4 is a flowchart demonstrating a bias data setting procedure which occurs in a switch ON condition.
Figure 5:
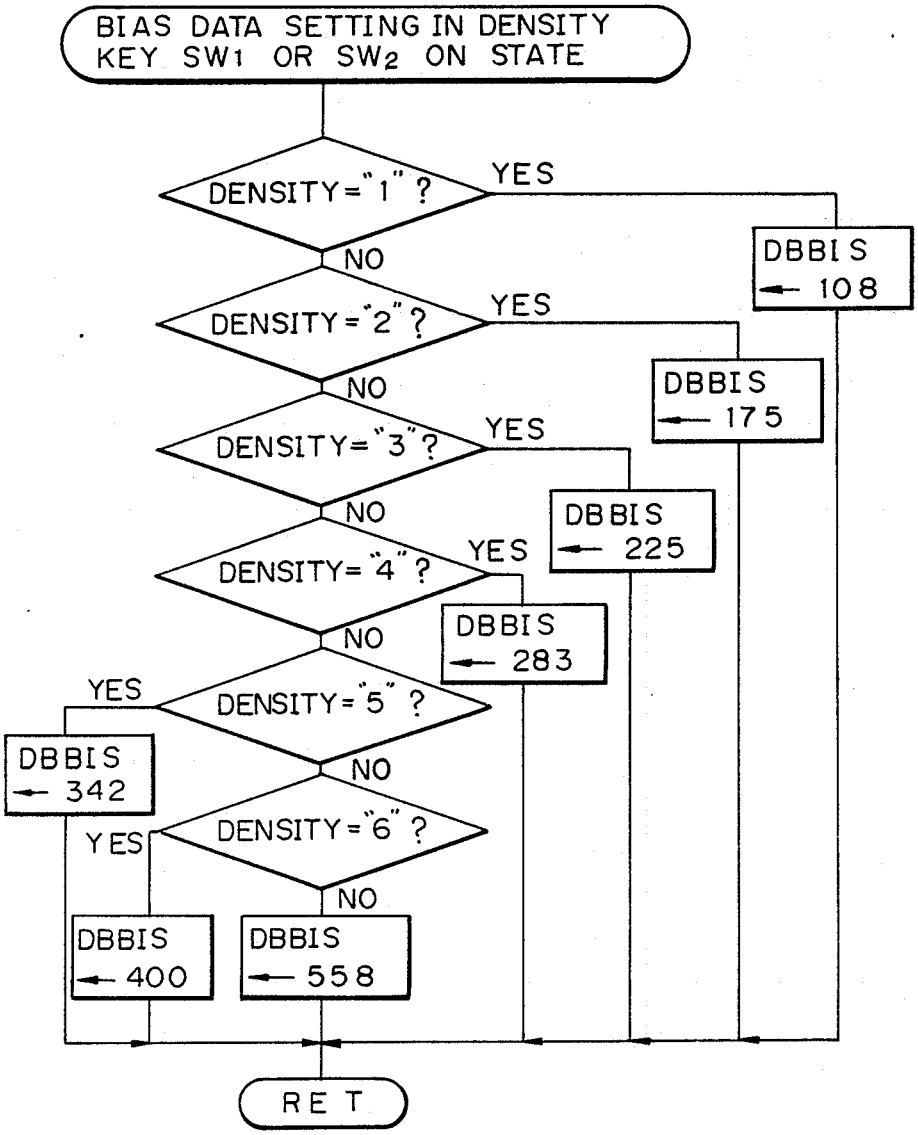
Fig. 5 PRIOR ART
FIG. 5 is a flowchart showing a procedure which is executed when any density key is operated to change density for loading a bias output data buffer with data associated with the density selected.
Figure 6:
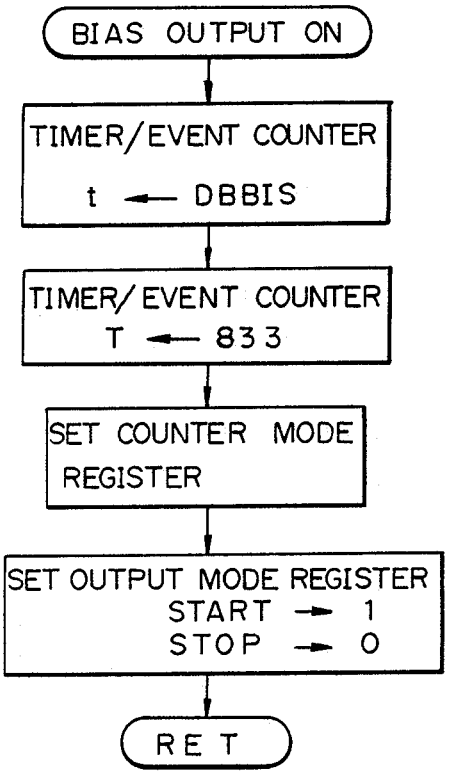
Fig. 6 PRIOR ART
FIG. 6 is a flowchart showing an operation which occurs in a bias ON state.
Figure 7:
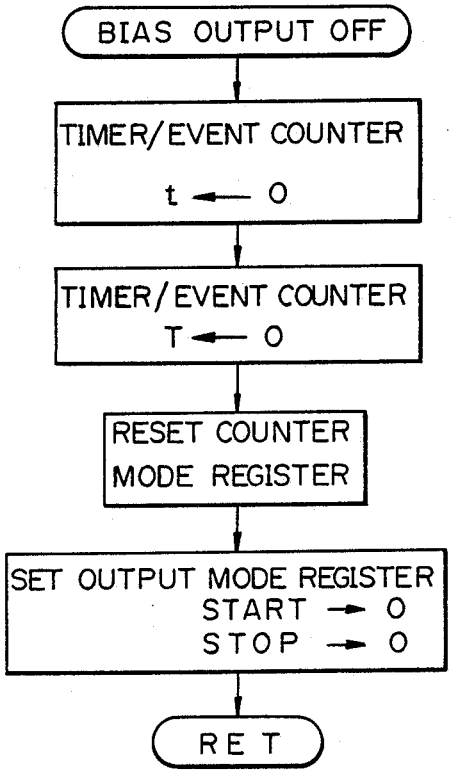
Fig. 7 PRIOR ART
FIG. 7 is a flowchart showing an operation which occurs in a bias OFF state.

FIG. 4 shows in a flowchart a procedure for setting bias data when a power switch of the copier is ON. For example, data "283" representative of density "4" is loaded as standard density in a data buffer which is adapted for bias output. On the other hand, FIG. 5 is a flowchart demonstrating a procedure for, when any of the key switches SW1 and SW2 is operated to change the density, loading the data buffer with another data. FIG. 6 shows an operation which occurs in a bias ON state. In FIG. 6, a content of the data buffer is selected to be t of the timer/event counter and data "833" associated with the period of 1 millisecond is selected to be T. Thereupon, a counter mode is set up and then START of an output mode register is set to cause the timer/event counter to produce an output. Further, FIG. 7 shows a flowchart demonstrating an operation which occurs in a bias OFF state. In FIG. 7, t and T of the timer/event counter are reset and then START and STOP of the output mode register are reset and set, respectively, thereby turning the bias output OFF.

With the above construction, the control device 10 is capable of providing a plurality of stable bias voltages $V_0$ as desired without complicating the programs. Nevertheless, this kind of scheme, i.e., increasing the bias voltage as stated above allows untransferred toner to enter a cleaning unit to increase the load of the latter, resulting in incomplete cleaning.

Figure 8:
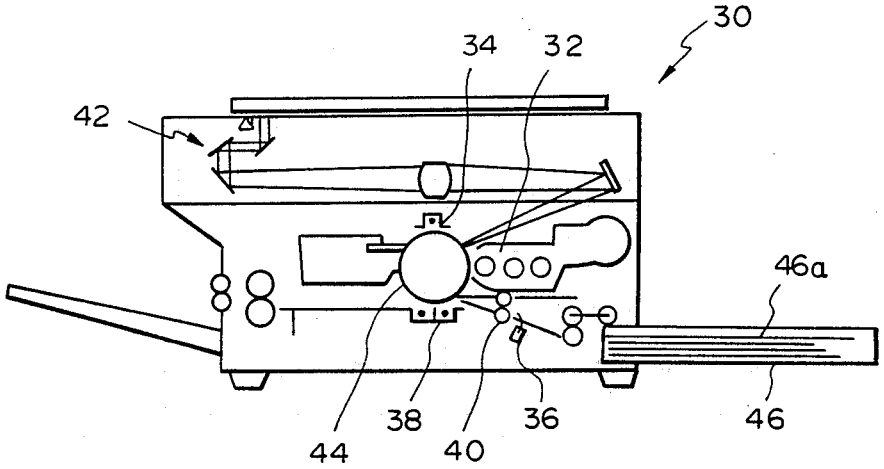
FIG. 8 is a schematic section showing a specific construction of a copier which is representative of a family of image forming apparatuses to which the present invention is applicable.

Referring to FIG. 8, a copier representative of a family of image recording apparatuses to which the present invention is applicable is shown and generally designated by the reference numeral 30. As shown, the copier 30 includes a developing roller 32 to which a bias voltage is applied, a charger 34 for charging a photoconductive drum 44, a preregister sensor 36, a transfer charger 38, a register roller 40, optics 42 for writing data, and the photoconductive drum 44. A paper cassette 46 is provided for feeding papers **46*a* one by one. The general operation of the copier 30** is well known in the art and therefore will not be described in detail herein.

Figure 9:
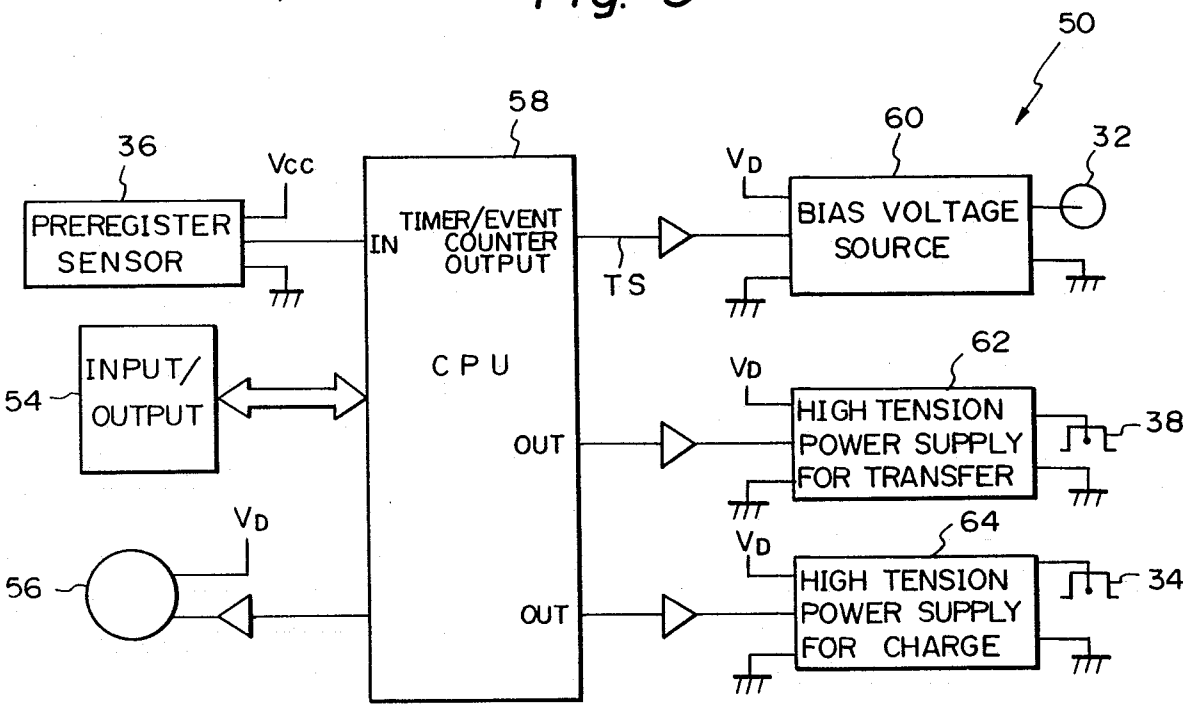
FIG. 9 is a schematic block diagram of a control device embodying the present invention.
Figure 11:
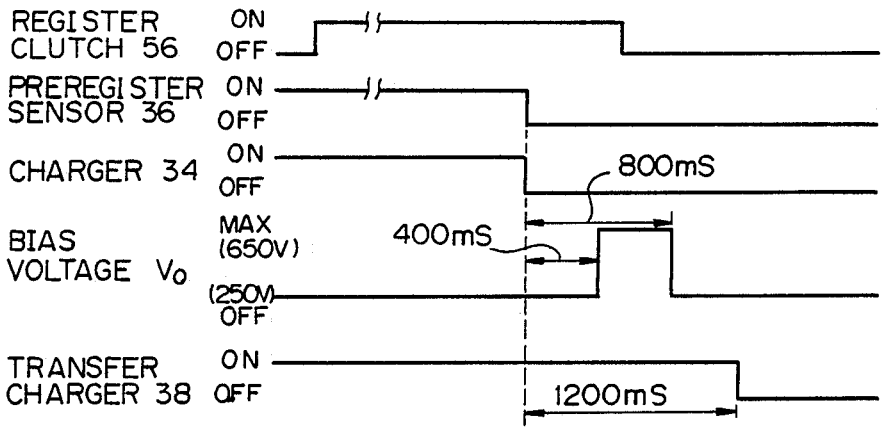
FIG. 11 is a timing chart useful for understanding the operation of the illustrative embodiment.

Referring to FIG. 9, a control device embodying the present invention is shown. The control device, generally 50, includes a CPU 58 connected to the preregister sensor 36, an input/output section 54 associated with various units of the copier 30, and a register clutch 56 for causing an image on the drum 44 into register with the paper **46*a*. The control device 50 further includes a bias voltage source 60 for applying a bias voltage to the developing roller 32, a high tension power supply 62 for applying a high voltage to the transfer charger 38, and a high tension power supply 64 for applying a high voltage to the charger 34. The CPU 58 delivers a trigger signal TS from its timer/event counter output terminal to the bias voltage source 60. The bias voltage source 60 in turn varies the pulse width of the trigger signal by using pulses having a predetermined period, thereby applying a desired bias voltage to the developing roller 32. This is the same as with the prior art which has been described with reference to FIGS. 1 to 7**.

Figure 10:
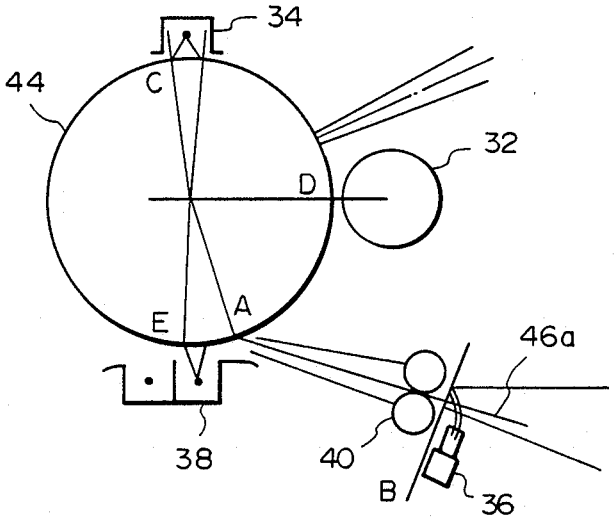
FIG. 10 shows a positional relationship between various units which are arranged around a photoconductive element in the illustrative embodiment.

Referring to FIG. 10, the charger, 34, developing roller 32, transfer charger 38, preregister sensor 36 and register roller 40 are arranged in sequence around the photoconductive drum 44. In the figure, there are shown a point A where an image on the drum 44 and a paper **46*a* join each other, a point B where the trailing edge of the paper 46*a* moves away and the preregister sensor 36 is turned off (the sensor 36 bifunctions to sense the trailing edge of the paper 46*a*), a point C where a charge may have been deposited on the drum 44 when the charger 34 is OFF, a point D wherein a bias voltage is applied to the drum 44, and a point E where the transfer charger 38 stops effectively acting on the paper 46*a*. The distance lAB between A and B, the distance lAD between A and D, the distance lCD between C and D and the distance lAE between A and E may be 100 millimeters, 60 millimeters, 80 millimeters, and 20 millimeters by way of example. The linear velocity $V_p$ of the paper 46a and drum 44** is 100 millimeters per second.

The operation of the control device 50 will be described with reference also made to FIGS. 11 and 12A to 12D.

Figure 12A:
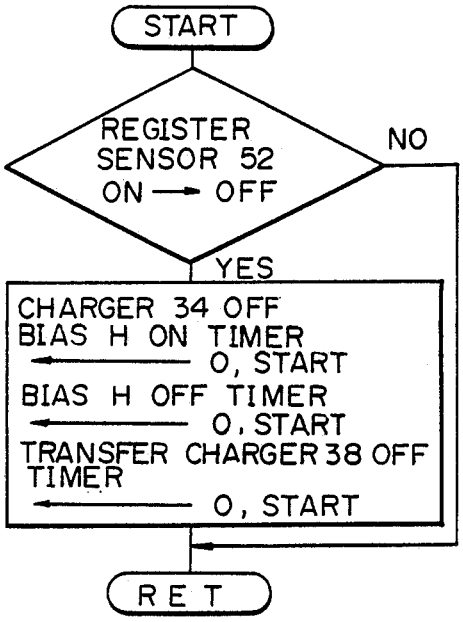
FIGS. 12A to 12D are flowcharts demonstrating the operations of the illustrative embodiment.
Figure 12B:
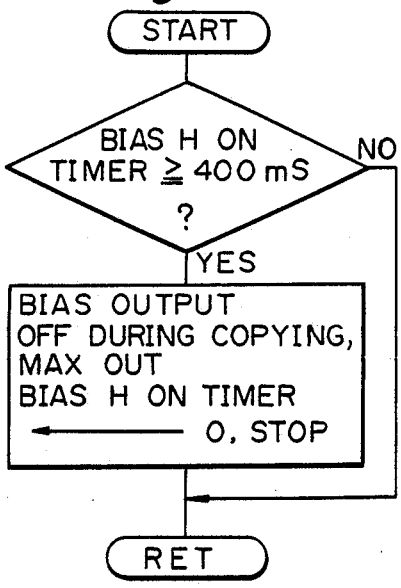
Figure 12C:
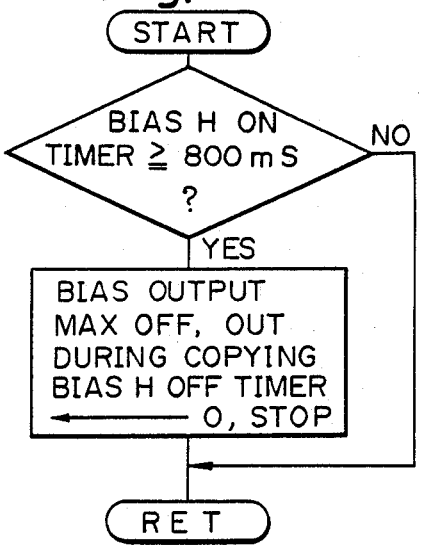
Figure 12D:
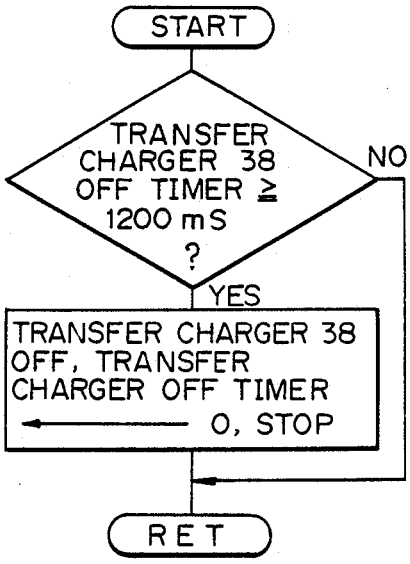

During a copying operation, as the register clutch 56 is coupled, the paper 46a is driven toward the transfer station. When the paper 46a moves away from the preregister sensor 36 (i.e. when the trailing edge of the paper 46a is sensed), the CPU 58 turns the high tension power supply 64 associated with the charger 34 OFF, and clears and starts a bias H ON timer and a bias H OFF timer for controlling the bias voltage source 60 and a transfer charge OFF timer for controlling the high tension power supply 62 (FIG. 12A). The bias H ON timer is adapted to turn the bias voltage $V_0$ to a high level (H) such as 650 volts when that part of the drum 44 which is associated with the trailing edge of the paper 46a has moved away from the developing roller 32, a developing bias being applied to the developing roller 32. More specifically, when a condition represented by $(lAB-lAD)/V_p=0.4$ second is reached, the bias H ON timer selects the high bias voltage H, stops counting, and is cleared (FIG. 12B). On the other hand, the bias H OFF timer is adapted to turn the bias voltage $V_0$ from the high level H to a copying level (e.g. 250 volts) when that part of the drum 44 on which a charge may have been deposited in an OFF state of the charger 34 moves away from the developing roller 32. More specifically, when $lCD/V_p$ reaches 0.8 second, the bias H OFF timer turns the bias voltage $V_0$ to the copying level, stops counting, and is cleared (FIG. 12C). The developing bias voltage (bias H) is confined in the charging range for charging the drum 44 in order to eliminate contamination of the background which is ascribable to the transfer of toner to the drum 44 due to the high bias. The transfer charger OFF timer turns the charger 38 OFF, stops counting, and is cleared when the trailing edge of paper 46a moves away from the transfer region, i.e. when $(lAB+lAE)/V_p=1.2$ second is reached (FIG. 12D).

The control timings discussed above are combined to reduce toner consumption associated with an untransferred image on the drum 44 and ascribable to the high bias voltage H. In addition, since the transfer charge is not applied, the electrostatic adhesion of toner to the drum 44 is not increased and therefore the load of a cleaning unit is reduced.

Figure 13:
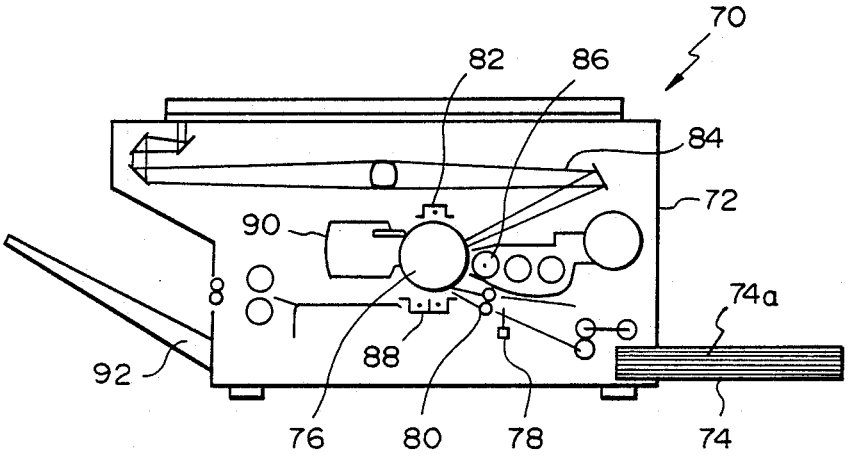
FIG. 13 is a schematic section showing another specific construction of the copier.

Referring to FIG. 13, another specific construction of a copier to which the present invention is applicable is shown. As shown, the copier 70 includes a housing 73, a paper cassette 74 loaded with a stack of papers 74a, a photoconductive drum 76, a preregister sensor 78 which turns on when a paper is present, a register roller 80, a charger 82, optics 84 for imagewise exposure, a developing roller 86 to which a bias voltage is applied, a transfer and separation charger 88, a cleaning unit 90, and a copy tray 92.

Figure 14:
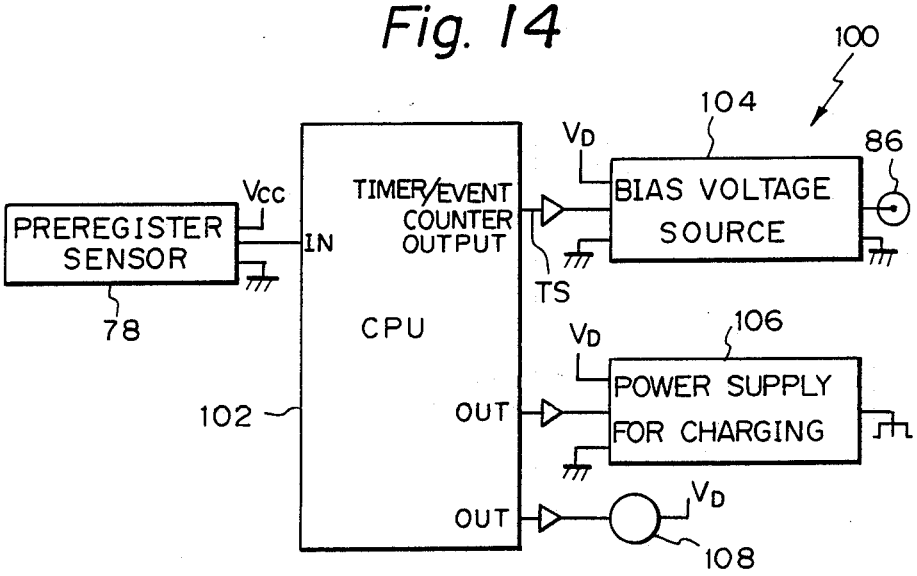
FIG. 14 is a schematic block diagram showing an alternative embodiment of the control device in accordance with the present invention.

FIG. 14 shows another embodiment of the control device in accordance with the present invention which is applicable to the copier 70 of FIG. 13. The control device, generally 100, includes a CPU 102, a bias voltage source 104, a power supply 106 for charging, and a register clutch 108. The CPU 102 delivers a trigger signal from its timer/event counter output terminal to the bias voltage source 104 to allow the latter to change the pulse width with a predetermined period and thereby produce a desired bias voltage.

Figure 15:
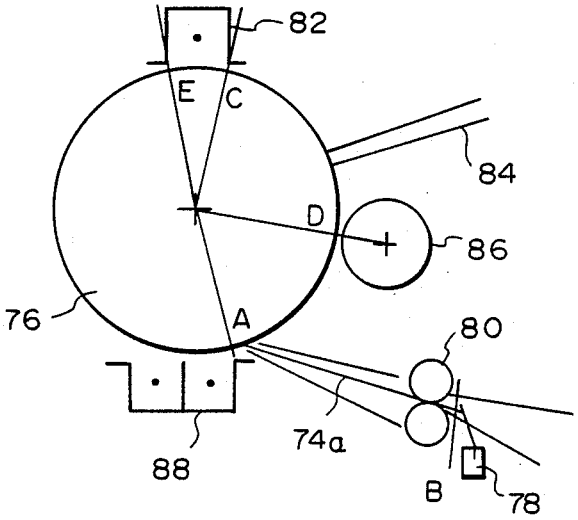
FIG. 15 shows a positional relationship between various units which are arranged around a photoconductive element in the alternative embodiment.

In FIG. 15, there is shown a positional relationship between the charger 82, developing roller 84, transfer and separation charger 88, preregister sensor 78 and register roller 80 which are arranged around the drum 76 of the copier 70. There are also shown a point A where the paper 74a and the drum 76 join each other, a point B where the trailing edge of the paper 74a moves away to turn the preregister sensor 78 OFF, a point C where the charge potential on the drum 76 is guaranteed when the charger 82 is OFF, a point D where a bias voltage is applied to the drum 76, and a point E where a charge may have been deposited on the drum 76 when the charger 82 is OFF. The distance lAB between the points A and B, the distance lAD between the points A and D, the distance lDC between the points D and C, and the distance lCE between the points C and E are assumed to be 100 millimeters, 60 millimeters, 80 millimeters, and 20 millimeters, respectively. The linear velocity of the paper 74a and drum 76 is assumed to be 100 millimeters per second.

Figure 16:
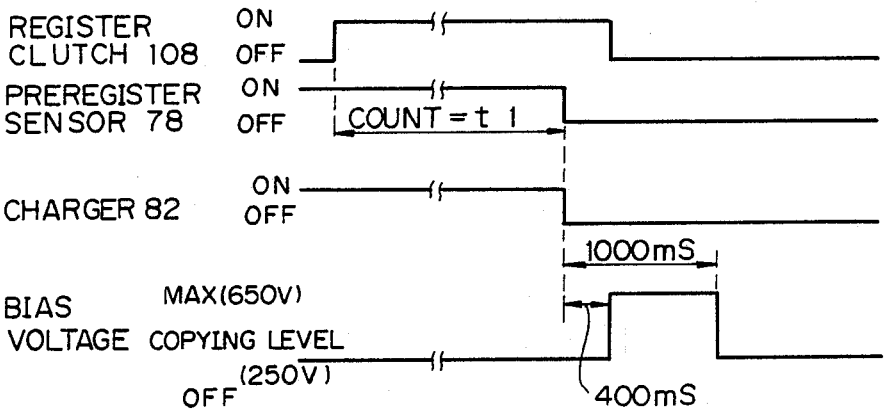
FIGS. 16 and 17 are timing charts useful for understanding the alternative embodiment.
Figure 17:
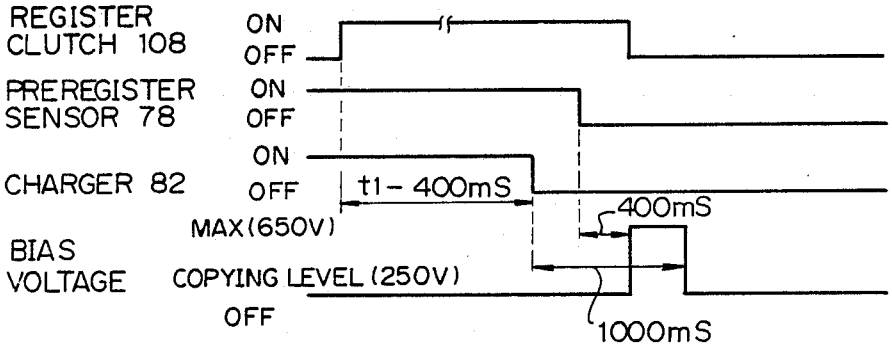

The operation of the control device 100 will be described with reference also made to FIGS. 16 and 17. FIGS. 16 and 17 are flowcharts respectively associated with the first copy and the second copy and onward as produced in a repeat copy mode.

Figure 18:
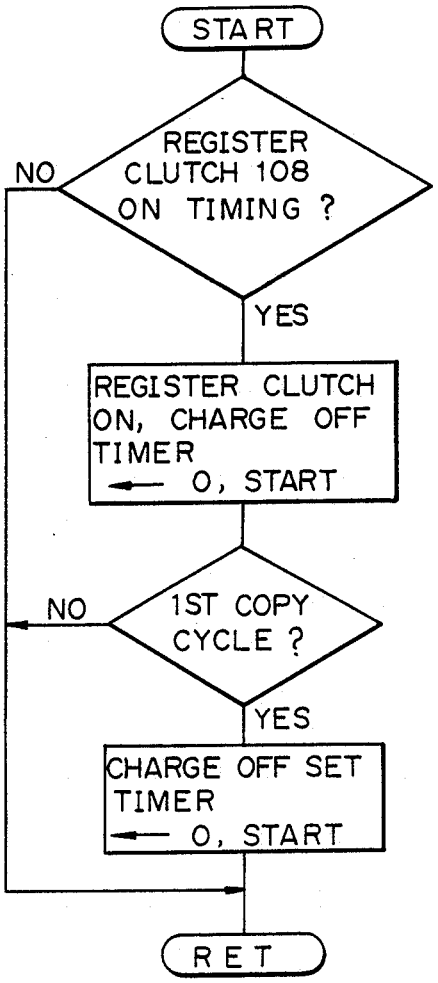
FIGS. 18 to 22 are flowcharts representative of programs which are associated with FIGS. 16 and 17.
Figure 19:
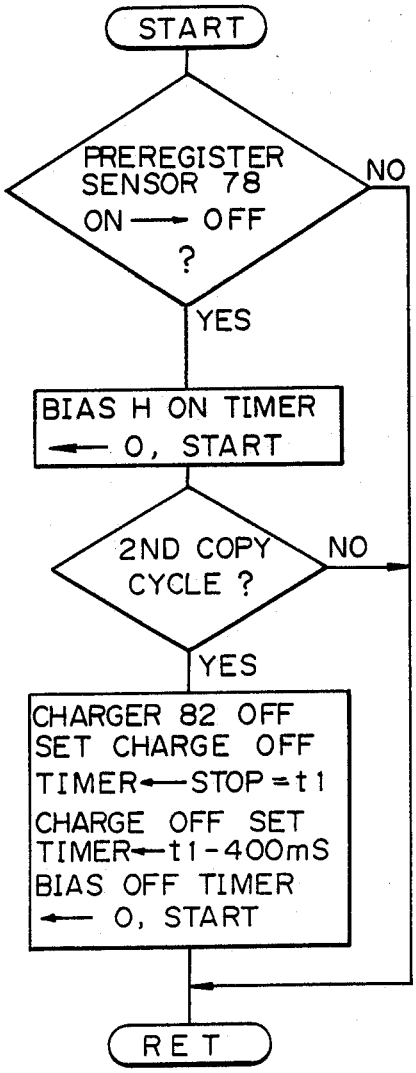

As shown, when the first copy is to be produced, the register clutch 108 is energized and the CPU 102 clears and then starts a charge OFF set timer. This timer is adapted to measure the length of the paper 74a in order to advance the charge OFF timing for the second copy and onward in a repeat copy mode (FIG. 18). As soon the paper 74a moves away from the preregister sensor 78 to turn the preregister sensor 78 OFF, the bias H ON timer is cleared and then started. At the same time, the charger 82 is turned OFF, the charge OFF set timer is stopped to advance the charge applying timer for the second paper and onward, and loads the charge OFF set timer with a value produced by subtracting 400 milliseconds from the data of the timer of that instant (FIG. 19).

Figure 20:
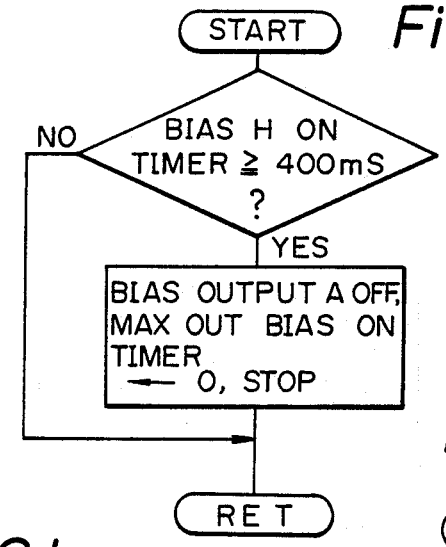
Figure 21:
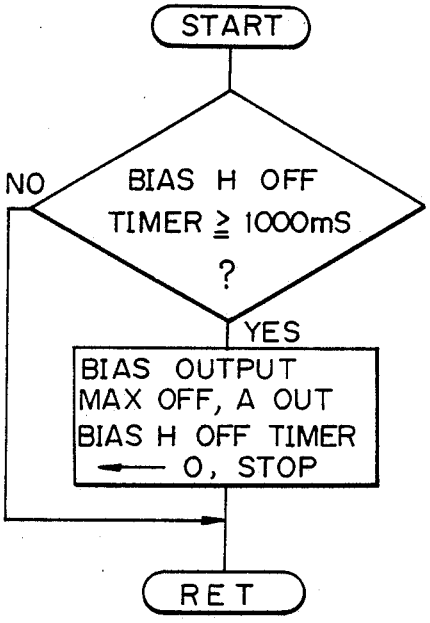
Figure 22:
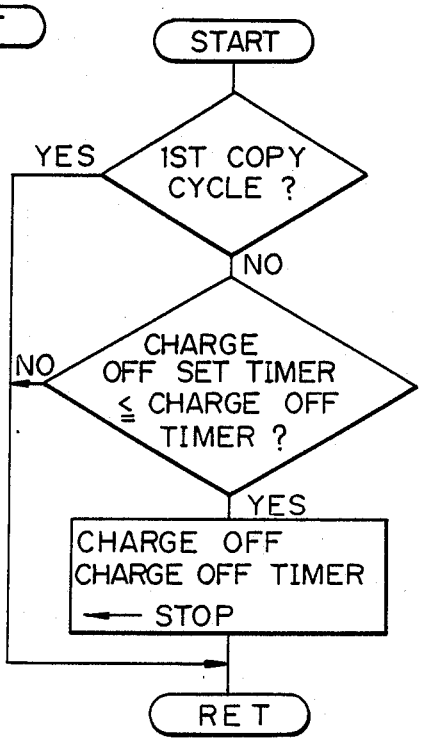

In FIG. 15, it takes the trailing edge of an image on the drum 76 a period of time of $(lAB-lAD)/V_p=(100-60)/1000=400$ milliseconds to reach a developing station from the instant when the pregister sensor 78 is turned OFF. Hence, when the bias ON timer reaches 400 milliseconds, the bias output is turned to a high level (H) (FIG. 20). Since the high bias H OFF timing needs only to be coincident with the time when the charged portion of the drum 76 moves away from the developing roller 86, all that is required is turning the bias H OFF upon the lapse of 1 second since the turn-off of the charger 82 (FIG. 21). For the second copy and onward, the charger 82 is turned OFF when the charger OFF timer reaches a value which is stored in the charge OFF set timer. This reduces the charge applying time by 400 milliseconds. More specifically, the high bias voltage H output time is reduced from 600 milliseconds associated with the first copy to 200 milliseconds.

In summary, it will be seen that a control device for an image recording apparatus of the present invention stops the operation of a transfer charger timed to the trailing edge of a paper. This reduces the load of a cleaning unit of the image recording apparatus and thereby promotes efficient cleaning. Further, in a copier which lacks an illumination type discharging means, the control device is capable of increasing a bias voltage upon the detection of the trailing edge of a paper and, hence, reduces the amount of toner consumed and that of toner collected and eliminates scattering of the toner without resorting to a complicated construction.

Various modifications will become possible for those skilled in the art after receiving the teachings of the present disclosure without departing from the scope thereof.

What is claimed is:

1. A control device for an image recording apparatus having a photoconductive element on which an image to be transferred to a paper is provided, charger means for charging said photoconductive element, and a bias voltage source for outputting a variable bias voltage for development, said control device comprising:

sensor means in sensing a first surface portion of said photoconductive element which is associated with a trailing edge portion of the paper when the image is transferred to the paper; and control means for controlling said charge means and said bias voltage source such that said charger means stops charging the first surface portion of said photoconductive element which is associated with the trailing edge portion of the paper and the bias voltage applied by said bias voltage source to a second surface portion of said photoconductive drum which follows the first surface portion is increased.

2. A control device as claimed in claim 1, wherein said sensor means comprises a sensor for sensing the trailing edge of the paper.

3. A control device as claimed in claim 2, wherein said sensor comprises a preregister sensor.

4. A control device as claimed in claim 2, wherein said control means stops, in response to an output of said sensor representative of the trailing edge portion of the paper, a charging operation of said charger means and increases the bias voltage which is applied to the second surface portion of said photoconductive drum which follows the first surface portion.

5. A control device as claimed in claim 1, wherein said image recording apparatus further has transfer charger means, said control device controlling said transfer charger such that a charging operation of said transfer charger means for charging the surface portion of said first photoconductive element is stopped.

* * * * *